United States Patent [19]

Thomas et al.

[11] Patent Number: 5,016,392

[45] Date of Patent: May 21, 1991

[54] REGULAR FOR FLUSH WINDOW

[75] Inventors: Gary R. Thomas, Livonia; Mark A. Huebner, St. Clair Shores, both of Mich.

[73] Assignee: Wickes Manufacturing Company, Southfield, Mich.

[21] Appl. No.: 483,666

[22] Filed: Feb. 23, 1990

[51] Int. Cl.[5] ..... E05F 11/48

[52] U.S. Cl. ..... 49/352; 49/225

[58] Field of Search ..... 49/352, 349, 225, 221, 49/502, 350, 351, 210, 211, 209

[56] References Cited

U.S. PATENT DOCUMENTS

| | | | |
|---|---|---|---|
| 1,085,877 | 2/1914 | Rheims et al. | 49/352 X |
| 1,206,052 | 11/1916 | Ternstedt . | |
| 2,979,327 | 4/1961 | Swanson et al. | 268/124 |
| 4,785,582 | 11/1988 | Tokue et al. | 49/352 X |
| 4,819,377 | 4/1989 | Bauer et al. | 49/221 |
| 4,829,711 | 5/1989 | Sambor | 49/352 X |

*Primary Examiner*—Philip C. Kannan

*Attorney, Agent, or Firm*—David A. Greenlee

[57] ABSTRACT

A window regulator track has a vertical slot with a lateral turn at the top to form a cam, an elongated follower in the slot which rotates when it reaches the cam, a carrier pivotally attached to the follower and pulled by a vertical reach of a driving cable to move the follower in the slot, and a helical cam arrangement coupled to the window and attached to the follower to generate outward movement of the window during the rotation of the follower in the cam.

5 Claims, 3 Drawing Sheets

REGULAR FOR FLUSH WINDOW

FIELD OF THE INVENTION

This invention relates to regulators for vehicle windows and particularly for windows mounted substantially flush with the outside vehicle surface when closed.

BACKGROUND OF THE INVENTION

Modern vehicle doors are thin, minimizing the space available for a window regulator, and the doors have a smooth curved outer surface in which the windows when closed are substantially flush with the outside door surface. The windows and the doors in such vehicles are not flat but have curvature; when the windows are opened they often require more space between the inner and outer panels of the door and thus further restrict the amount of space remaining for the regulator mechanism.

In order to mount the regulator mechanism in the available space, to control the path of the window and to minimize the upper opening between the inner and outer door panels, it is desirable to impart a nominally horizontal component of window movement during the final closing movement. That is, when the window is nearly closed it moves upward and outward to the desired flush position.

Window closing movements in the upward and outward direction have long been known and various camming mechanisms have been proposed to achieve that result. U.S. Pat. No. 1,206,052 to Ternstedt uses a slotted cam plate with a compound curvature and a chain-driven cam follower to guide the window movement simultaneously upwardly and outwardly and then downwardly to finally close the window.

U.S. Pat. No. 2,979,327 to Swanson et al discloses a regulator mechanism which is very space consuming, but achieves substantially full upward movement followed by outward movement of the WindoW. That mechanism employs dual guide tracks on each side of the window with a follower wheel in each of the four tracks, two of the tracks having outwardly turned paths to push the window outward when the follower wheels reach the turns in the tracks.

U.S. Pat. No. 4,819,377 to Bauer et al discloses a single track regulator having a slot with a bifurcated upper end. A pulley with two projecting pins engaged in the slot guides upward movement in the track. A drive cable is wrapped around the pulley to pull the pulley along the track and to impose a moment on the pulley so that the pins are driven into the bifurcated slot portions to rotate the pulley during the final upward closing movement. The pulley is drivingly coupled to the window through a helical cam which moves the window outward when the pulley rotates so that the path of the window has both upward and outward components at the time of closing.

SUMMARY OF THE INVENTION

It is therefore an object of the invention to provide an improved regulator which achieves a combined upward and outward motion in the final closing movement and which is more compact and more durable than the prior art regulators. In particular, it is an object to improve on the regulator of U.S. Pat. No. 4,819,377 to Bauer et al by eliminating the pulley and the moment imposed on the mechanism by the cable, while retaining the upward and outward motion during window closing.

The invention is carried out by providing a track with a vertical slot terminating in an upper cam slot, an elongated follower slidable in the slot for vertical movement on the track and rotation by the cam slot about an axis on the slot center line, a carrier pivotally mounted to the follower at the axis and a cable attached to the carrier on the axis to move the carrier linearly along the axis without a turning moment, and a cam mechanism coupled between the follower and the window and actuated by the follower for moving the window out during rotation of the follower.

BRIEF DESCRIPTION OF THE DRAWINGS

The above and other advantages of the invention will become more apparent from the following description taken in conjunction with the accompanying drawings, wherein like references refer to like parts and wherein.

DESCRIPTION OF THE INVENTION

Figure 1:
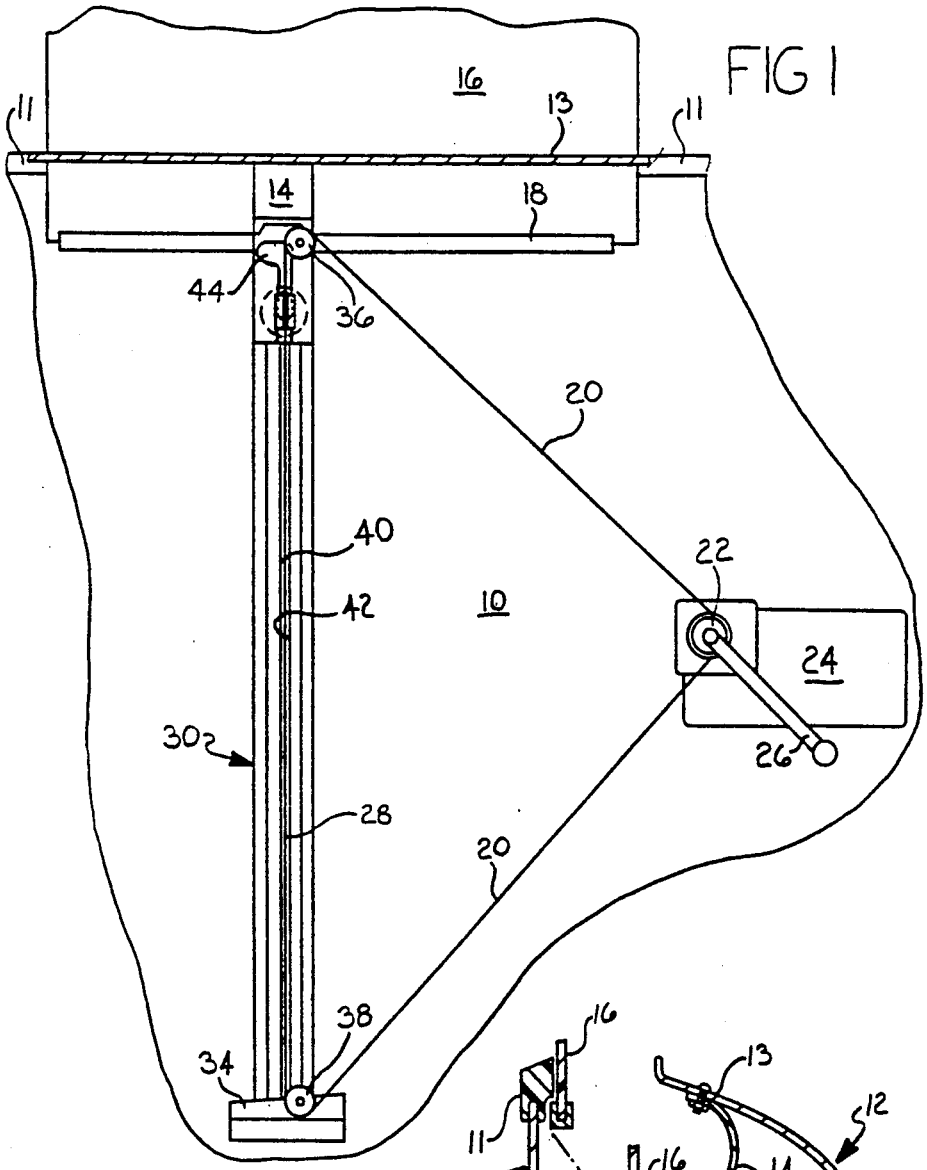
FIG. 1 is a side elevation of a partly broken away door panel mounting a window regulator according to the invention.

The invention is described in the context of a window movable in the generally vertical direction in a vehicle door. Since the door and the window may be curved, the window movement usually is not in a true vertical direction. The term "vertical" is then used to refer to the upward and downward direction of window movement. Since the invention is directed primarily to the mechanism for operating a window in a vehicle door, most of the parts of the door have been broken away in the drawings.

Figure 2:
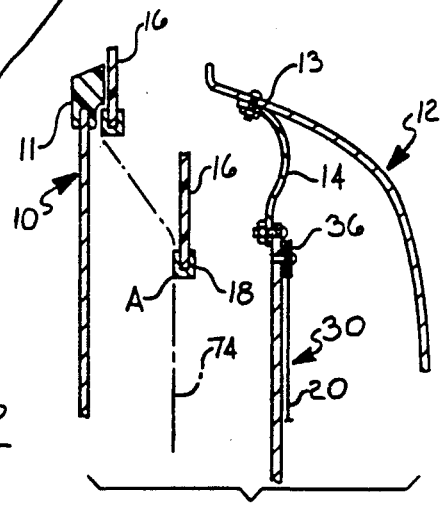
FIG. 2 is a cross-sectional front elevational view of a door illustrating the opening between inner and outer door panels and the path of the window during closing.

In FIGS. 1 and 2, sections of the outer door panel 10 and inner door panel 12 are shown, with the inner door panel 12 being the base upon which the regulator mechanism parts are mounted. A bracket 14 may be bolted at its upper end to the window sill 13 of the inner door panel 12. The outer panel 10 and the inner panel 12 are spaced at their upper edges to form the opening or slit through which the window 16 moves. Opposite the sill 13 is a polymer or rubber seal 11 along the upper edge of the lower outer door panel 10 which defines the lower boundary of the window opening. The lower portion of the window 16 incorporates a U-shaped channel 18 along its lower edge which comprises part of the carrier for the window.

FIG. 1 shows the assembly of the whole regulator mechanism of this invention. This mechanism comprises basically a closed loop flexible cable 20, a portion of which is wrapped around a driving drum 22. The drum 22 may be driven by an electric reversible motor 24 or by a hand crank 26. Thus, the cable serves as an actuator and all movements of the window are caused by a pull in the cable in either one or the other direction.

Instead of a cable, another flexible drive member may be used.

The closed loop of cable 20 is provided with a vertical reach 28 which is guided along a parallel vertical track 30. The track 30 is supported at its upper end by the bracket 14 and at its lower end by a door-mounted bracket 34. The upper end of the track 30 and the bracket 34 support upper and lower guiding pulleys 36 and 38, respectively.

Figure 3:
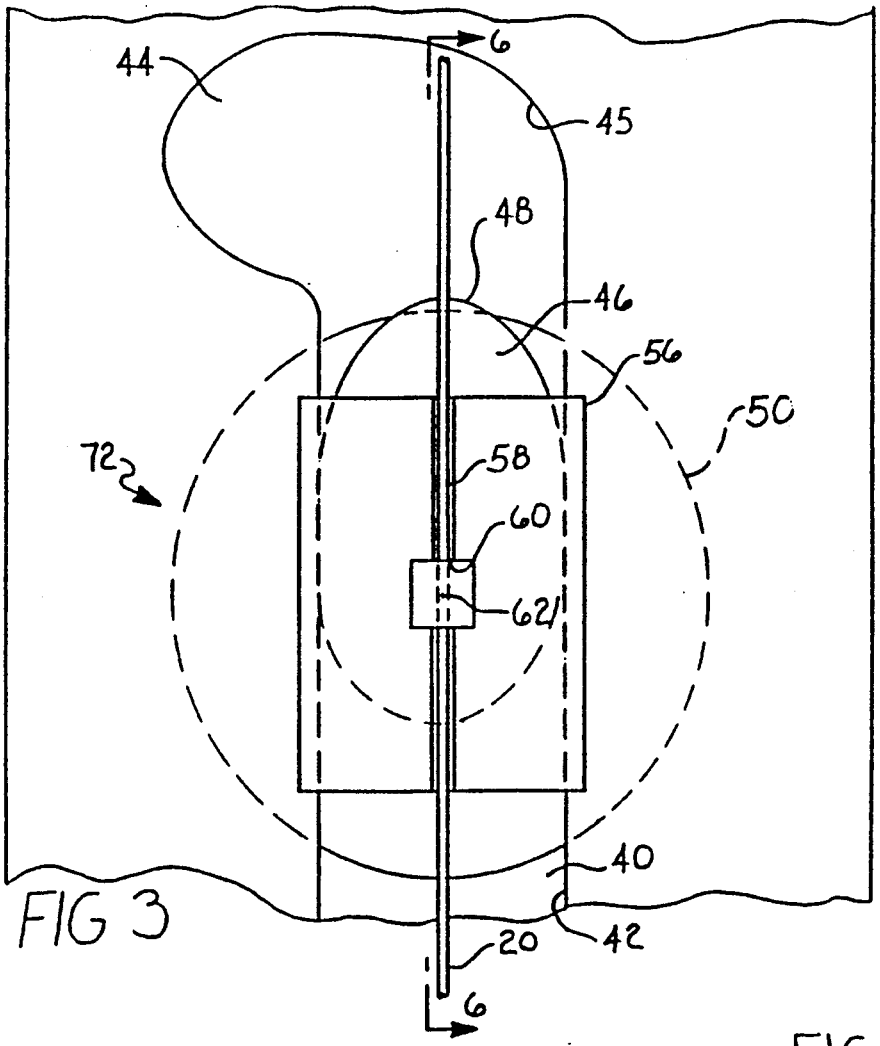
FIGS. 3 and 4 are enlarged schematic views of the upper portion of the regulator channel and cam arrangement of the regulator of FIG. 1 in a near window-closed position and in a full closed position, respectively.

A slot 40 extends along the length of the bracket 30 and is bounded by sides 42. The slot 40 terminates at its upper end in a generally foot-shaped cam 44. The heel 45 of the foot-shaped cam is rounded, as seen in FIG. 3. In effect, the slot 40 turns laterally at its upper end. The remainder of the slot 40 is straight.

Figure 4:
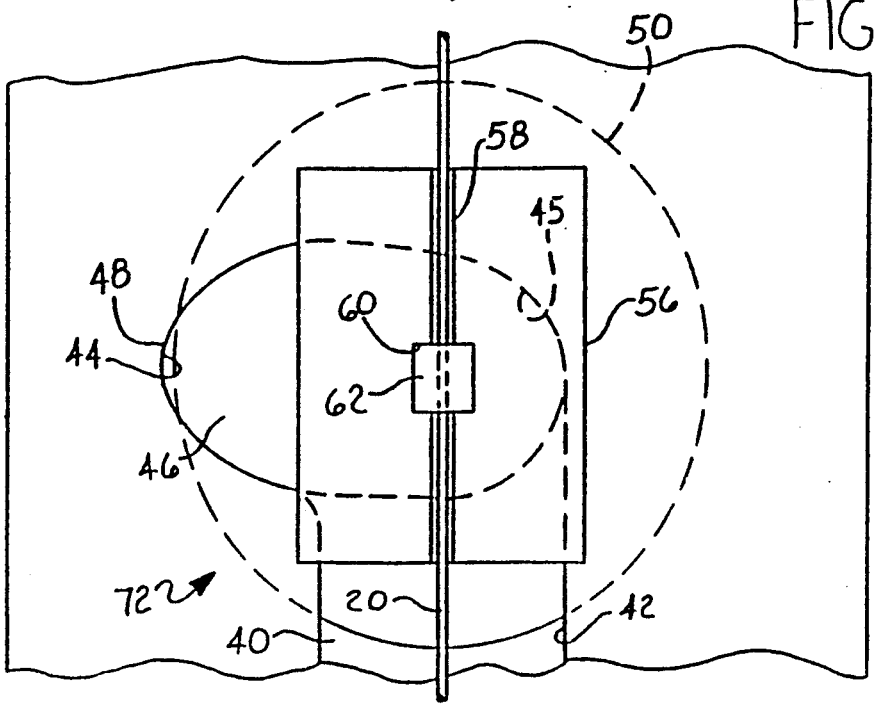

As shown in FIGS. 3–6, an elongated cam follower 46, having a rounded upper nose 48, is slidably disposed in the slot 40 so that, upon window closing, the follower 46 maintains a nose-up attitude until it reaches the top of the slot 40. Its further movement is guided by the rounded heel portion 45 to turn 90° into the foot-shaped cam 44 as seen in FIG. 4. The cam follower 46 also has a rounded lower end shaped to facilitate its turn into the cam slot portion 44.

A cylindrical cam 50 extends from the follower 46 and turns or rotates as the follower turns. The follower 46 and the cam 50 are preferably one piece, but in any event they move together. The cam 50 is larger in diameter than the width of the slot 40 so that during its movement it slides on the side of the track 30 nearest the outer panel 10. The cam 50 has a central axial bore 52 which also extends through the follower 46 for receiving a stud or post 54. The post 54 has a head 55 adjacent the outer end of the cam 50 to hold the cam 50 and follower 46 on the post.

A rectangular carrier 56 slidable on the other side of the track 30 engages the follower 46 and supports the post 54 which is rotatably mounted in the bore 52. The follower 46 moves along the track as the carrier 56 moves and allows the follower 46 and cam 50 to rotate relative to the holder. The carrier 56 has a vertical groove 58 in its outer face and a central recess 60 aligned with the post 54. The cable 20 extends parallel to the slot and passes through the groove 58 in the carrier 56. The cable in the groove 58 prevents rotation of the carrier 56. A die cast cable slug 62 engages the cable and resides in the recess 60 to pull the carrier in the direction of the cable movement.

The cam 40 and the follower 46 are shaped so that, as the follower moves into the cam 40, there is one point on the follower which remains on the straight line defined by the cable 20. This point defines the axis 63 of rotation of the follower 46 and cam 50. The recess 60 and the post 54 are aligned with that point so that there is no side pull on the cable or lateral movement of the post and cam 50 as the follower 46 moves into the foot-shaped cam 44.

Figure 5:
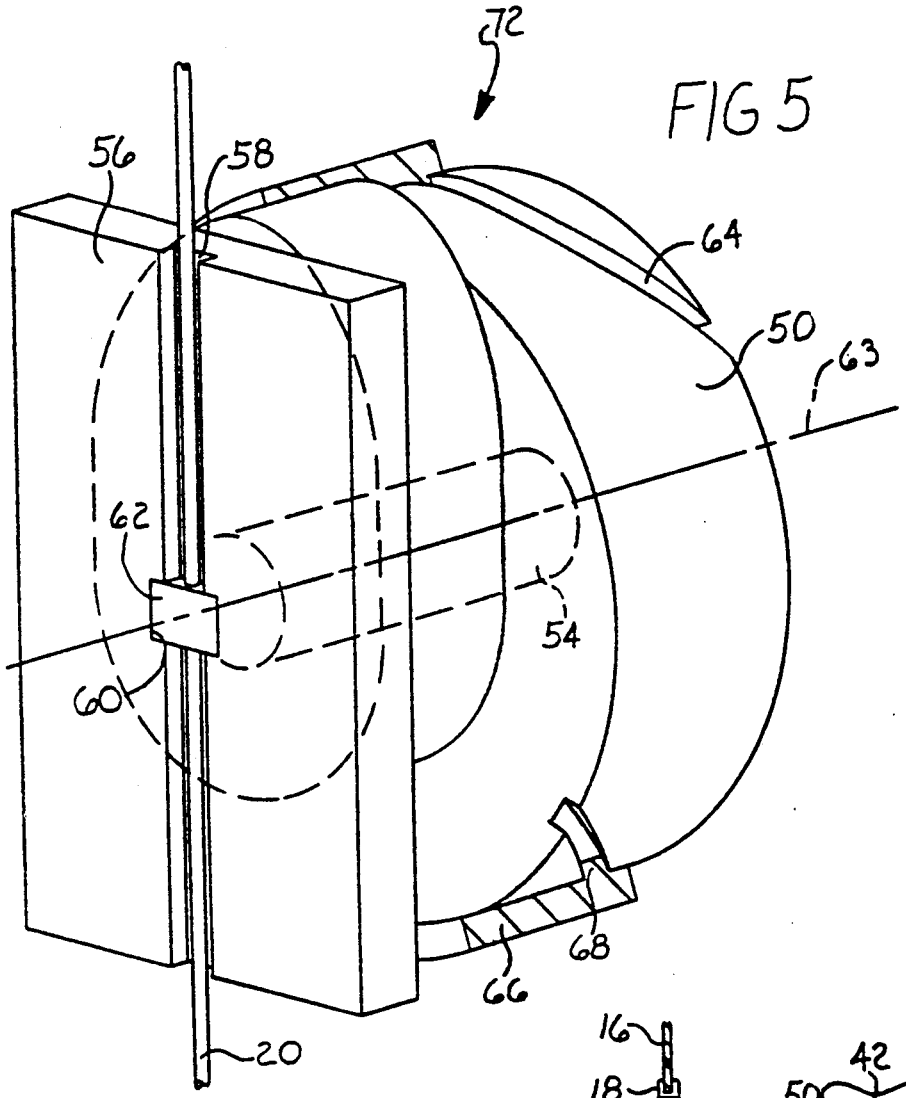
FIG. 5 is an isometric view of the cam follower and the rotary cam assembly of FIG. 2.
Figure 6:
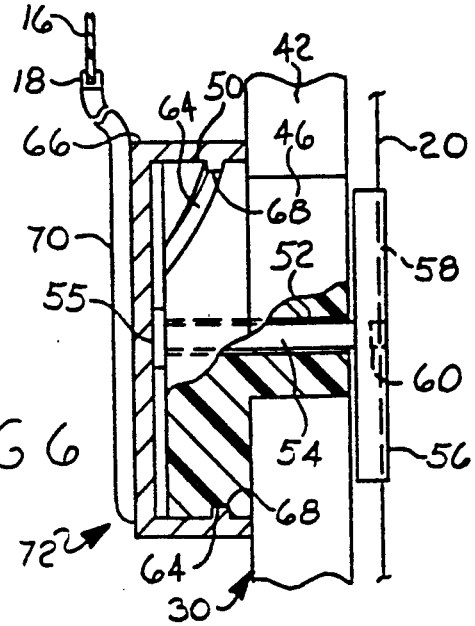
FIG. 6 is a cross-sectional view of the cam and window lift arrangement taken along line 6—6 of FIG. 3.

The cylindrical cam 50 has a pair of helical grooves 64 on its outer surface. A cam follower 66 in the form of a cup loosely fits over the cam 50 and has a pair of pins 68 extending inwardly to engage the grooves 64 on the cam 50. The helical grooves are threaded in a direction to cause the follower 66 to move laterally away from the track 30 when the cam follower 50 turns into the foot-shaped cam 44 upon window closing. The cam follower 66 is secured to a bracket 70 which in turn supports the U-shaped channel 18 on the bottom of the window. The cam follower 46 and integral cam 50, the carrier 56 and post 54, and the cam follower 66 as shown in FIG. 5 comprise a drive assembly 72.

In operation, as the crank 26 or motor 24 turns the drum 22, the cable 20 moves between the pulleys 36 and 38 to move the drive assembly 72 along the track 30. The cable pulls the drive assembly 72 straight along the track without imposing any moment on the assembly 72 so that the follower 46 slides freely in the straight portion of the track slot 40 without being forced against either side of the slot. When the cable pulls the assembly 72 to near the window-closed position, the nose 48 of the follower 46 is guided laterally by the heel 45 to turn the follower 46 into the foot-shaped cam 44 of the slot 40. During this turn the consequent rotation of the cam 50 causes the cam follower 66 to push out away from the track 30 to close the window 16 against the seal 11. As shown in FIG. 2, the point A on the corner of the channel 18 moves along the path indicated by the broken line 74. The point A moves in a straight line until the follower 46 turns, whereupon rotation of cam 50 causes slots 64 to force pins 68 outwardly; this causes point A to move along a curve or slope to its window-closed situs.

The specific slope or shape of the curve can be tailored to a particular application by altering the shape of the slot 40 and/or the shape of the cam slot 64. Thus the two cams work together to bring the window out to the flush position during the final portion of the upward movement of the window. The rotation moment is furnished by the interaction of the follower 46 in the slot 40 and the cable force on the drive assembly is only vertical. The path of the post 54 is always in a straight line and coincident with the center line of the straight portion of the slot 40 so that the cam 50 and follower 66 move only in a straight line even during the final closing motion of the window. Window opening is accomplished by moving the cable downward and the cam operation works in reverse so that the point A traverses the same path 72.

It will thus be seen that the regulator disclosed herein is compact and has few parts, the cable imposes no rotating moment on the drive assembly for easy sliding movement in the slot of the track and minimal wear due to rubbing on the side of the slot. In addition the cam shapes can be designed for optimum effort and motion in window closing.

The embodiments of the invention in which an exclusive property or privilege is claimed are defined as follows;

We claim:

1. A window regulator for a flush window comprising:

a track for guiding window movement, the track including a slot having a straight portion terminating in a cam portion at the top of the slot, a drive assembly slidably mounted in the slot for guidance along the track, drive means, a flexible drive member coupled to the drive means and defining a path parallel to the track which is aligned with the slot, and is centrally attached to the drive assembly for moving the drive assembly only parallel to the straight portion of the slot, the drive assembly including a cam follower slidably disposed in the slot and elongated in the direction of the slot for alignment with the slot and for rotation by the cam portion upon window-closing movement, and means coupling the drive assembly to the window and responsive to the rotation of the cam follower for moving the window outwardly during window closing movement of the drive assembly along the track.

2. The invention as defined in claim 1, wherein the drive assembly comprises a carrier means, means coupling the carrier means to the flexible drive member for imparting drive force only in the direction of the flexible drive member, and means for rotatably supporting the cam follower on the carrier means whereby linear movement of the carrier means to the top of the slot effects rotation of the cam follower.

3. The invention as defined in claim 1, wherein the drive assembly comprises a carrier means, a post extending laterally from the carrier means and extending through the center line of the slot straight portion, means for coupling the flexible drive member to the carrier means at a point aligned with the post for imparting drive force only in the direction of the center line and aperture means in the cam follower for rotatably supporting the cam follower on the post whereby linear movement of the carrier means to the top of the slot effects rotation of the cam follower.

4. A window regulator for a flush window comprising:

a track with a vertical slot terminating in an upper cam slot, an actuator for movement parallel to the vertical slot, a carrier secured to the actuator and mounted for linear movement along the track upon actuator movement, means for preventing rotation of the carrier, an elongated follower slidably disposed in the slot and rotatably connected to the carrier for vertical movement on the track and for rotation by the cam slot about an axis on the slot center line during carrier vertical movement in the cam slot, and a cam mechanism coupled between the follower and the window and actuated by the follower for moving the window out upon rotation of the follower in the cam slot.

5. A window regulator for a flush window comprising:

a track with a vertical slot terminating in an upper cam slot, a cable drive mechanism including a cable running adjacent the vertical slot, a carrier secured to the cable and mounted for linear movement along the track upon cable movement, means for preventing rotation of the carrier, an elongated follower slidably disposed in the slot and rotatably connected to the carrier for vertical movement on the track and for rotation by the cam slot about an axis on the slot center line during carrier vertical movement in the cam slot, and a cam mechanism coupled between the follower and the window and actuated by the follower for moving the window out upon rotation of the follower in the cam slot.

* * * * *

UNITED STATES PATENT AND TRADEMARK OFFICE

CERTIFICATE OF CORRECTION

PATENT NO. : 5,016,392

DATED : May 21, 1991

INVENTOR(S) : Gary R. Thomas et al

It is certified that error appears in the above-identified patent and that said Letters Patent is hereby corrected as shown below:

In the COVER PAGE:

In the title "REGULAR" should read --REGULATOR--.

In the SPECIFICATION:

Col. 1, line 2, in the title "REGULAR" should read --REGULATOR--

Signed and Sealed this

Fifteenth Day of September, 1992

*Attest:*

DOUGLAS B. COMER

*Attesting Officer*

*Acting Commissioner of Patents and Trademarks*